US006991259B2

(12) United States Patent
Schwarzbauer et al.

(10) Patent No.: US 6,991,259 B2
(45) Date of Patent: Jan. 31, 2006

(54) APPARATUS AND METHOD FOR IMPROVED BUSINESS FORM WITH INTEGRATED CARD

(75) Inventors: Andrew M. Schwarzbauer, North Aurora, IL (US); Charles L. Casgrande, Batavia, IL (US)

(73) Assignee: Strata-Tac, Inc., Batavia, IL (US)

( * ) Notice: Subject to any disclaimer, the term of this patent is extended or adjusted under 35 U.S.C. 154(b) by 384 days.

(21) Appl. No.: 09/780,222

(22) Filed: Feb. 9, 2001

(65) Prior Publication Data

US 2002/0000718 A1 Jan. 3, 2002

Related U.S. Application Data

(63) Continuation-in-part of application No. 09/203,733, filed on Dec. 2, 1998, now abandoned.

(60) Provisional application No. 60/067,133, filed on Dec. 2, 1997.

(51) Int. Cl.
*B42D 15/00* (2006.01)

(52) U.S. Cl. ..... 283/62; 283/101; 283/107; 283/108; 283/109; 283/81; 428/13; 428/40; 428/41.7; 428/41.8; 428/42.2; 428/42.3; 428/43; 428/192; 428/194; 428/195; 428/914; 156/260; 156/277

(58) Field of Classification Search ..... 283/107, 283/108, 109, 101, 62; 428/13, 40, 43, 195, 428/914, 41.7, 41.8, 42.2, 42.3, 41.9, 192, 428/194; 156/260, 277
See application file for complete search history.

(56) References Cited

U.S. PATENT DOCUMENTS

| | | | | |
|---|---|---|---|---|
| 2,255,019 | A | 9/1941 | Wolters et al. | 156/268 |
| 2,896,351 | A | 7/1959 | Johnson | 40/702 |
| 3,166,186 | A | 1/1965 | Karn | 428/42.3 |
| 3,252,234 | A | 5/1966 | Goodman | 40/638 |
| 3,420,364 | A | 1/1969 | Kennedy | 206/460 |

(Continued)

FOREIGN PATENT DOCUMENTS

| | | |
|---|---|---|
| CA | 1274979 | 3/1990 |

(Continued)

*Primary Examiner*—Boyer D. Ashley
*Assistant Examiner*—Mark Henderson
(74) *Attorney, Agent, or Firm*—Polster, Lieder, Woodruff & Lucchesi

(57) ABSTRACT

The present invention is a business form with an integrated card. The form comprises a base paper layer having top and bottom surfaces and a periphery, a primary film layer having top and bottom surfaces and a periphery, a breakaway layer coated on the top surface within the periphery of the primary film layer, and an adhesive layer wherein the breakaway layer is adhesively secured to the bottom of the secondary film layer, at least one die cut through the top and bottom surfaces within the periphery of the form layer, through the adhesive layer, and through the breakaway layer. The die cut base paper layer, adhesive layer and breakaway layer comprise an information card wherein the breakaway layer has a greater affinity for the adhesive layer than the top surface of the primary film layer such that when the information card is removed from the form, the breakaway layer stays adhered to the bottom surface of the base paper layer. A secondary film layer and second adhesive layer may also be added for added rigidity of the information card.

25 Claims, 4 Drawing Sheets

U.S. PATENT DOCUMENTS 3,996,679 A 12/1976 Warneke ..... 40/1.5
4,248,919 A 2/1981 Davis ..... 428/40
4,479,838 A 10/1984 Dunsirn et al. ..... 156/247
4,508,365 A 4/1985 Hawes ..... 281/2
4,523,825 A 6/1985 Norris ..... 354/301
4,544,590 A 10/1985 Egan ..... 428/40
4,664,982 A 5/1987 Genovese et al. ..... 428/447
4,742,954 A 5/1988 Shishido ..... 229/92.8
4,863,772 A * 9/1989 Cross ..... 428/41.8
4,890,862 A 1/1990 Buchholz ..... 283/62
4,910,058 A 3/1990 Jameson ..... 428/42
4,925,716 A 5/1990 Haas ..... 428/41
5,039,652 A 8/1991 Doll et al. ..... 503/206
5,042,842 A 8/1991 Green et al. ..... 283/101
5,049,443 A 9/1991 Kuszaj et al. ..... 428/332
5,129,682 A 7/1992 Ashby ..... 283/81
5,131,686 A 7/1992 Carlson ..... 283/75
5,172,938 A 12/1992 Schmidt ..... 283/109
5,209,514 A 5/1993 Hebert ..... 283/81
5,219,183 A 6/1993 McKillip ..... 283/62
5,271,787 A 12/1993 Hoffman et al. ..... 156/268
5,318,326 A 6/1994 Garrison ..... 283/101
5,320,387 A 6/1994 Carlson ..... 283/75
5,328,538 A 7/1994 Garrison ..... 156/249
5,362,106 A 11/1994 Longtin ..... 283/109
5,413,532 A 5/1995 Raby ..... 462/2
5,439,255 A 8/1995 McIntire et al. ..... 283/62
5,462,488 A 10/1995 McKillip ..... 462/26
5,466,013 A 11/1995 Garrison ..... 283/107
5,482,328 A * 1/1996 Stewart ..... 281/81
5,501,393 A * 3/1996 Walz ..... 229/92.8
5,589,025 A 12/1996 Garrison ..... 156/268
5,595,403 A * 1/1997 Garrison ..... 283/74
5,660,896 A * 8/1997 Normand et al. ..... 428/13
5,736,212 A 4/1998 Fischer ..... 428/42.2
5,782,497 A * 7/1998 Casagrande ..... 283/107
5,916,665 A 6/1999 Fischer et al. ..... 428/195
6,022,051 A * 2/2000 Casagrande ..... 283/107
6,099,943 A * 8/2000 Moeller et al. ..... 428/195.1
6,190,747 B1 2/2001 Fischer ..... 428/42.2
6,217,078 B1 * 4/2001 Roth et al. ..... 283/81
6,227,574 B1 * 5/2001 Fischer ..... 283/105
6,322,655 B1 * 11/2001 Casagrande ..... 283/107
6,328,340 B1 * 12/2001 Fischer ..... 283/62
6,331,018 B1 * 12/2001 Roth et al. ..... 283/81
6,350,342 B1 * 2/2002 Steidinger et al. ..... 283/81
6,352,287 B2 * 3/2002 Casagrande ..... 283/81
6,409,871 B1 * 6/2002 Washburn et al. ..... 156/256
6,410,111 B1 * 6/2002 Roth et al. ..... 428/40.1
6,531,024 B1 * 3/2003 Braun ..... 156/277
6,533,325 B1 * 3/2003 Steidinger ..... 283/105
2001/0030020 A1 * 10/2001 Nandy et al. ..... 156/289
2005/0067830 A1 * 3/2005 Mijdam et al. ..... 283/101
2005/0123705 A1 * 6/2005 Dronzek et al. ..... 428/40.1
2005/0147781 A1 * 7/2005 Dronzek et al. ..... 428/40.1
2005/0153091 A1 * 7/2005 Challoner et al. ..... 428/42.3

FOREIGN PATENT DOCUMENTS

DE 4107469 9/1992
EP 0613792 9/1994
FR 2 691675 12/1993
GB 2209993 6/1989
JP 58 025 379 2/1983
JP 1214485 8/1989
JP 1285390 11/1989
JP 000426863 A1 * 4/1990
JP 2121896 5/1990
WO 92/05036 2/1992
WO WO 95/20493 * 3/1995
WO WO 90/11194 10/1999
WO WO03020532 * 3/2003

* cited by examiner

APPARATUS AND METHOD FOR IMPROVED BUSINESS FORM WITH INTEGRATED CARD

CROSS-REFERENCE TO RELATED APPLICATIONS

This application is a continuation-in-part of U.S. application Ser. No. 09/203,733, filed Dec. 2, 1998, now abandoned, which claims the benefit of U.S. provisional application Ser. No. 60/067,133 filed Dec. 2, 1997.

FIELD OF THE INVENTION

This invention relates to business forms having integrated, removable information cards. More specifically, the invention incorporates the application of zones of variation in the strength of the peel required to remove the card from the form.

BACKGROUND OF THE INVENTION

It is common for businesses to use business forms that incorporate membership cards or other kinds of cards requiring the signature of the user, or other indicia, to be added at the time of issuance. The part of the business form that houses the integrated card may be referred to as a patch. Patches traditionally consist of several layers of adhesive, transparent film and other chemical agents.

Previously, card and form combinations were non-integral and had the card "piggybacked" on the form. In these combinations, the cards utilized an additional release liner and were produced with a label press. The cards were then affixed to the forms in a separate step. These forms had the obvious disadvantage of requiring that the cards be produced separately from the forms on a different piece of equipment and then later assembled onto the forms.

Forms with integral cards are created by diecutting or otherwise defining the card within the form itself. Thus, the form becomes part of the card and is therefore referred to as the form layer or base paper layer. This results in a card and form combination which is much thinner than the piggyback or affixed type since the form layer actually is part of the card. The card must be retained within the form layer when placed through the processes of printing, shipping, handling and other operations, until it is ultimately removed by the consumer. Forms with integrated cards can be produced using either an adhesive plus a splittable varnish or single layer of dry adhesive to retain the card within the form layer.

The current generation of integrated card products exhibit numerous problems. First, the card can be very difficult to remove because the card material is in the same plane as the form layer itself. Second, these forms can have compatibility problems with many laser printers since some film products exhibit a tendency to build up static electricity and even melt, shrink, or curl when passed though such printers. The release characteristics of the cards from the form are also inconsistent due to the characteristics of the splittable varnish or dry adhesive. Finally, many of the existing methods result in a card that cannot be signed.

For affixed cards, in many instances, the patch is so thick that laser printers cannot be used to print on the card.

To overcome these problems, an improved business form with integrated card must balance the need to keep the card securely bound to the form during processing and the need to provide the consumer easy release of the card from the business form. In addition, a signature compatible area must be added once removed from the form. To meet the first objective, the peel strength (or "release level") must be sufficiently strong to hold the card to the form and hold the primary substrate to the back of the form. To meet the second objective, the release level must be sufficiently weak to allow the removal of the card from the form by untrained end users. These requirements impose practical limitations that were previously considered mutually exclusive.

To solve the problem of providing two opposing release levels to the same integrated card, the present invention focuses on the two critical areas of the form where most problems occur. Accordingly, high peel strength is required at the outermost portion or edge of the patch to satisfy the first objective. Next, the need for easy release to satisfy the second objective is most critical to the outside quarter inch of the card itself. Once the first quarter inch of the card has peeled up from the form, the end user can get a grip on it, and most users can easily peel it from the form.

BRIEF SUMMARY OF THE INVENTION

The present invention is a business form having an integrated, removable information card. The basic form comprises a base paper layer having top and bottom surfaces and a periphery, and a multi-layered laminate patch adhesively secured to the base paper layer with an adhesive, preferably a pressure sensitive adhesive.

(Version 1) The laminate has a primary film layer having top and bottom surfaces and a periphery, which is in turn bonded, preferably chemically and mechanically bonded, directly to a layer of breakaway coating. The bond between the breakaway coating and the primary film layer is designed to release and allow the layers of the laminate to separate. The base paper layer is permanently or semi-permanently adhered by an adhesive, preferably pressure sensitive adhesive, layer to the breakaway layer which is in turn bonded, preferably chemically and mechanically bonded, directly to the primary film layer with a releasable bond. The base paper layer, adhesive layer, and breakaway layer are penetrated by a die cut which defines the perimeter of the integrated card.

(Version 2) An alternative version of this invention can be made by adding an additional layer of film (the secondary film layer) which provides added stiffness, thickness, and tear resistence to the integrated card. The secondary film layer is bonded to the breakaway coating layer by either a second layer of permanent or pressure sensitive adhesive. The secondary film layer is in turn bonded to the base paper layer by the same adhesive layer that bonded the breakaway coating to the base paper layer in version 1. So what is added is a secondary layer of film, and a layer of permanent or pressure sensitive adhesive between the pressure sensitive adhesive and the breakaway coating described in version 1. The base paper layer, first adhesive layer, secondary film layer, second adhesive layer, and breakaway layer are penetrated by a die cut which defines the perimeter of the integrated card.

Alternatively, the periphery of the primary film layer may be made large enough or the area of the breakaway layer small enough to allow the primary film layer to directly adhere to the base paper layer (or secondary film layer in version 2) by direct contact with one of the adhesive layers. The breakaway layer has a greater affinity for the adhesive layer than the top surface of the primary film layer.

One of the main advantages of the present invention stems from the breakaway layer composition. The composition is applied to the primary film layer in liquid form, as a coating, but later solidifies into a film. The composition may be composed of clear urethane, acrylic, or acetate-based polymers, or any other substance which can be cured from liquid to solid and which retains breakaway characteristics substantially the same as the clear urethane, acrylic, or acetate based polymers. The use of a breakaway layer has three advantages: it acts as the plastic laminate that remains on the back of the card; it acts as a dry release agent which both bonds to, and detaches from the primary film layer; and its ink receptive properties provide a signable surface. Thus, by using a breakaway layer which functions both as a release and lamina, a minimal card thickness is obtained which was not possible with previous patches. Previously, patches used two layers to perform what the present invention does in a single layer.

The breakaway coating sandwiched between the adhesive layer and primary film layer transfers to the base paper layer of the form (version 1), or the secondary film layer (version 2). The transfer of the breakaway coating to the adhesive layer upon removal of the card creates a protected, glossy, signable non-stick surface on the back of the card, which may be manually signed by writing directly onto the film, or printed on using laser printing techniques.

The breakaway layer may be coated in varying thicknesses and patterns, or may be chemically varied in patterns when coated or printed onto the primary film layer in order to allow variation in peel strengths in different areas of the primary film layer. The breakaway layer may also contain a texture, holographic images, and other textures which are created when the liquid breakaway coating is cast on the Primary film layer. Any texture on the primary film layer will be formed in mirror image in the breakaway coating as it cures.

This invention also satisfies both release level objectives described above by varying, preferably by use of varying compounds, and/or by varying the thickness of any such compound, the peel strength across the card. One embodiment of the invention incorporates an area with an increased peel strength, or tighter release, in the center of the laminated card. The release level is sufficiently strong to securely bond the card and the primary film layer to the business form through processing, for example, in a laser printer. An area of weaker peel strength, or easier release, is placed on the outside edges of the patch positioned so that the die cut for the integrated card will extend approximately ¼ inch beyond the center zone of the patch with the tight release. This positions the edge of the card in the area of the patch with the easy release.

A second embodiment incorporates a pattern in the adhesive layer that bonds the breakaway coating to the base paper layer of the form (version 1), or the second adhesive layer that bonds the secondary film layer to the breakaway coating (version 2). This pattern creates areas on at least one edge of the card that are not bonded to the primary film layer. This provides a "Lift-edge" for the card as described above.

A third embodiment uses an area of decreased peel strength, easy release, in the center of the laminated card. An area of higher peel strength, or tight release, is placed on the outside edges of the patch. This zone must be situated so that the area that forms the integrated card may be die cut from the center of the patch without touching the tight zone. This embodiment can be made either with the Version 1 or Version 2 constructions described above. The easy release level is sufficiently weak to allow easy release of the information card from the base paper layer, yet incorporating the area of stronger peel strength overcomes the problem of delaminating the primary film layer from the back of the form when placing the forms through processing machines, such as automatic folding and inserting machines, that place stress on the patch on the back of the form.

A fourth embodiment incorporates a zone of permanent or semi-permanent bond on the outside edges of the patch. This zone is created by coating the breakaway coating in a pattern. The pattern leaves a void at the outside edge of the patch, where the permanent bond is desired. This void allows the next layer of the construction, the adhesive, preferably pressure sensitive adhesive (version 1) or the second, preferably permanent adhesive (version 2) to come in direct contact with the primary film layer in the un-coated zone. This zone must be situated so that the area that forms the integrated card may be die cut from the center of the patch without touching this zone in the same manner as the third embodiment. It is preferred that a strip of about 3/16 inch wide be used for this permanent or semi-permanent lamination zone so that the primary film layer of the patch will remain permanently or semi-permanently adhered to the paper base layer within the tolerance levels of the slitting process. This embodiment can be made either with the Version 1 or Version 2 constructions described above.

In a fifth embodiment of the invention, different breakaway layer compositions are incorporated across the primary film layer to create different zones of varying peel strength such as in the first and second embodiments. This embodiment can be made either with the Version 1 or Version 2 constructions described above.

Other objects of the invention will be evident from the following detailed descriptions of the invention and drawings.

DETAILED DESCRIPTION OF THE INVENTION

Figure 1A:
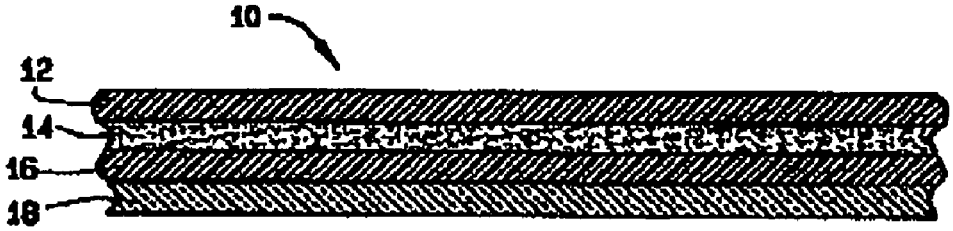
FIG. 1*a* is a cross-sectional view of the patch showing the several layers of the patch.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

The patch is made in master roll form by coating a primary film layer with a breakaway layer using a breakaway layer composition. Next, in the preferred embodiment, the breakaway layer is coated with pressure sensitive adhesive and laminated to a temporary, removable silicone liner. In an alternative embodiment, the breakaway layer is adhered to a secondary film layer with either a permanently cured or pressure sensitive type of adhesive. The secondary film layer is then coated with the pressure sensitive adhesive and laminated to the temporary, removable release liner. The master roll of these constructions is then slit to smaller finished rolls which contain the patterns of adhesives and breakaway coatings desired by the manufacturer of the integrated card portion of the form.

The base paper layer (the form) may be bonded to the pressure sensitive adhesive of the patch after the temporary release liner is removed from the patch material, and the patch is cut from the finished roll.

After the patch is applied to the back of a business form, the form is die cut from the front side to define the card itself. The cut defines the area and shape of the form that is peeled out by the end user to become the information card. The cut penetrates any optional laminates placed on top of the base paper layer, the base paper layer, the adhesive layer, and the breakaway layer stopping before it cuts through the primary film layer (version 1). In another preferred embodiment, (version 2) the cut penetrates any optional laminates placed on top of the base paper layer, the base paper layer, a first adhesive layer, a secondary film layer and second adhesive layer, and the breakaway layer, stopping before it cuts through the primary film layer. Once the die cut is applied to the form, the card is held into the form itself only by the strength of the bond between the breakaway coating and the primary film layer. The sides of the card are cut clean and completely from the form by the die cut, and the card remains in the same plane as the form itself until the end-user peels the card from the form.

The information card is signature compatible after removal from the business form by virtue of the breakaway coating on the back of the laminate which serves the dual purpose of accepting the ink of a signature, and providing a dry release from the primary film layer. This coating transfers from the primary film layer to the adhesive layer when the card is peeled from the form. The breakaway layer is created by coating the primary film layer with a urethane, acrylic, or acetate based coating that, once dried, forms a bond to the film substrate which will later release or be transferred from the primary film substrate either directly to form (version 1), or to the secondary film substrate which is itself bonded to the form (version 2). The coating releases completely and intact. It does not rupture or break, but rather transfers when it releases from the primary substrate. This release/transfer results in the adhesive layer receiving or capturing the breakaway layer. The breakaway layer does not have sufficient integrity or strength to function as a film layer itself, but when laminated to another layer, it will protect that layer and provide a signable glossy or textured look as if it were the film itself. The breakaway layer may be of any thickness providing these release/transfer characteristics, but is preferably between 10 and 200 microns thick.

The breakaway coating is applied in a striped pattern or with varying thickness or varying compounds to the primary film layer. The pattern may be designed to coat no breakaway coating on the primary film layer in the area at the outside edge of the primary film layer. This uncoated area is approximately 3/16 inch. By leaving this zone uncoated with the breakaway composition, the adhesive that is applied to bond the breakaway layer to the base paper layer will come directly in contact with the primary film layer, thereby permanently or semi-permanently laminating the primary substrate to the base paper layer (version 1). In another preferred embodiment, wherein a secondary film layer and second layer of adhesive are incorporated, the primary film layer would permanently or semi-permanently adhere to the secondary film layer.

Additionally, the breakaway coating layer may be of any shape to create alternating areas of adhesion and nonadhesion of the base paper layer or secondary film layer to the primary film layer. Varying the pattern of adhesive layers can also be used to accomplish alternating zones of adhesion and nonadhesion of the base paper layer or secondary film layer to the primary film layer.

The release and transfer of the breakaway coating is accomplished by laminating the breakaway coated surface of the primary film layer to the base paper layer or secondary film layer with either a pressure sensitive adhesive or a permanently-cured type laminating adhesive. The adhesive used for this purpose must have sufficient peel strength to overcome the bond of the breakaway coating to its primary substrate, and hold it securely to the base paper layer or secondary film layer. The breakaway layer may be composed of a material having variations in thickness across the primary film layer which in turn creates variation in peel strength across the primary film layer. The peel strength may be relatively low adjacent the periphery of the primary film layer or relatively high adjacent the primary film layer.

Once the breakaway layer has been transferred, the surface of the breakaway layer, which had been bonded to the primary film layer, becomes the exposed surface of the coating on the base paper layer or secondary film layer. This is significant due to the ability of the coating to transfer texture from the primary film layer to the integrated card. The primary film layer is usually a film with a smooth surface, but textured films with matte coatings, holographic images, or other types of texture can be coated with a breakaway coating, and transfer their texture to the secondary substrate with this type of application as well.

In another embodiment, the breakaway layer is coated in a pattern with different breakaway compositions in zones across the primary film layer to vary the release level across the primary film layer. This approach enables the application of areas of easy release on the outside edges of the patch and tighter release in the center portion of the patch, or areas of tighter release on the outside edges of the patch and easy release in the center portion of the patch. In the first instance, this enables the end user to more easily peel of the integrated card from the business form by starting the release of the card easily, while at the same time holding card and primary film layer securely in the form. In the second instance, this allows easy release of the card while providing sufficient peel strength to hold the primary film layer to the back of the business form through processing, such as in a laser printer.

The easy release may also be designed to allow the edge of the card to pop up and out of the plane of the base paper layer of the form when the form is bent at the easy release zone of the patch. This feature is sometimes referred to as a "lift-edge." The edge provides end users with a grip on the card. This feature guarantees easy and consistent release of the card from the form. The invention exhibits excellent compatibility with laser printers such that the heat and static generated by such devices does not compromise the integrity of the invention or the consistency of the card release. This embodiment can be made either with the Version 1 or Version 2 constructions described above.

The standard integrated card is 3 ⅜ inches wide by 2 ⅛ inches high, but can be made of any size and shape that will fit into standard printing apparatus, such as a laser printer. The pattern of release may be arranged so that the card that is cut out of the form has right and left sides extending past the tighter release zone into the easy release zone. The card should extend at least 7/32 of an inch into the easy release zone of the patch, but may be shorter in length depending on the release strength of the breakaway layer composition.

DETAILED DESCRIPTION OF THE DRAWINGS

Referring now to the drawings in detail, where like numerals refer to like parts or elements, there is shown in FIG. 1*a* patch 10 initially comprised of the following four layers from top to bottom: a lamina with release agent 12, a permanent adhesive 14, a breakaway layer 16 having a peripheral edge 16', and a primary film layer 18 having a peripheral edge 18'. In another preferred embodiment, a secondary film layer and second adhesive layer may be added to create six layers from top to bottom: a lamina with release agent 12, a first adhesive layer 14, a secondary film layer 15, a second adhesive layer 15.5, a breakaway layer 16 having a peripheral edge 16', and a primary film layer 18 having a peripheral edge 18'. The layers of both embodiments are stacked with the lamina with release agent 12 being the top layer and the primary film layer 18 being the bottom layer. When the patch is manufactured, the lamina with release agent 12 is used to segregate the permanent adhesive 14 from the other layers of material when rolled and is peeled away during the manufacturing process, exposing the permanent adhesive layer 14 for bonding to the intended surface.

Figure 2A:
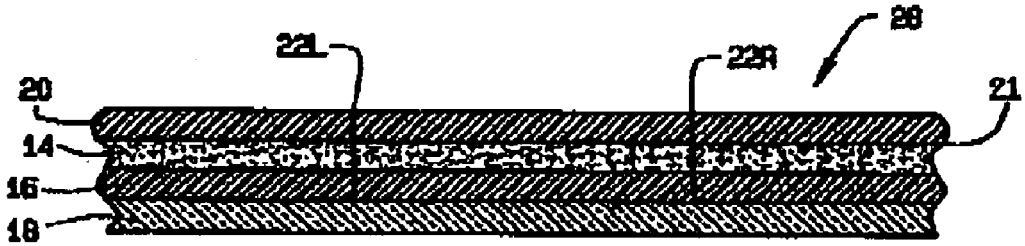
FIG. 2*a* is a cross-sectional view of the patch of FIG. 1*a* showing the layers of the patch attached to a business form.
Figure 2B:
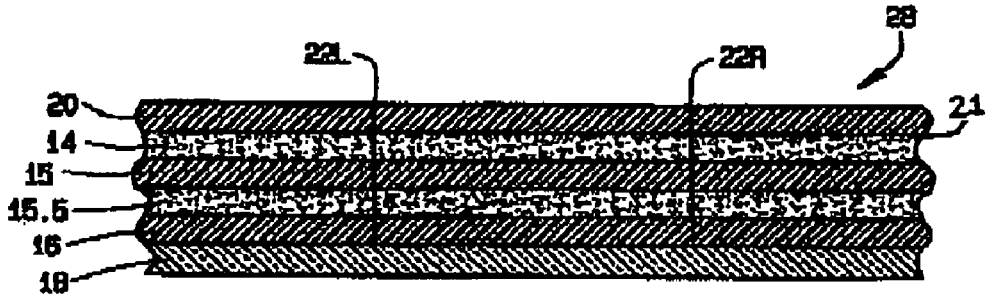
FIG. 2*b* is a cross-sectional view of the patch of FIG. 1*b* showing the additional optional secondary film and secondary adhesive layers of the patch attached to a business form.

Referring to FIG. 2*a* once the lemma with release agent 12 is removed, the three remaining layers 14, 16, 18, act as a single unit and are adhered, for example, to the bottom 21 of a paper business form 20. Referring to FIG. 2*b*, five layers 14, 15, 15.5, 16, and 18 act as a single unit. As shown in FIG. 2*a*, the patch then consists of four layers: a paper base layer 20 having a peripheral edge 20', a permanent adhesive 14, a breakaway layer 16 having a peripheral edge 16', and a primary film layer 18 having a peripheral edge 18'. As shown in FIG. 2*b*, the patch consists of six layers: a paper base layer 20 having a peripheral edge 20', a first adhesive layer 14, a secondary fun layer 15, a second adhesive layer 15.5, a breakaway layer 16 having a peripheral edge 16', and a primary film layer 18 having a peripheral edge 18'. The first four layers are then die cut at 22L and 22R in both FIGS. 2*a* and 2*b*, through to the bottom of the breakaway layer 16 Related, opposed, parallel die cuts (not shown) are simultaneously cut into the patch 10 so as to form the desired geometric shape; in this case a rectangle with rounded corners to form the card C. The primary film layer 18 is not cut and is left attached to the bottom 21 of the paper base layer 20.

Figure 3A:
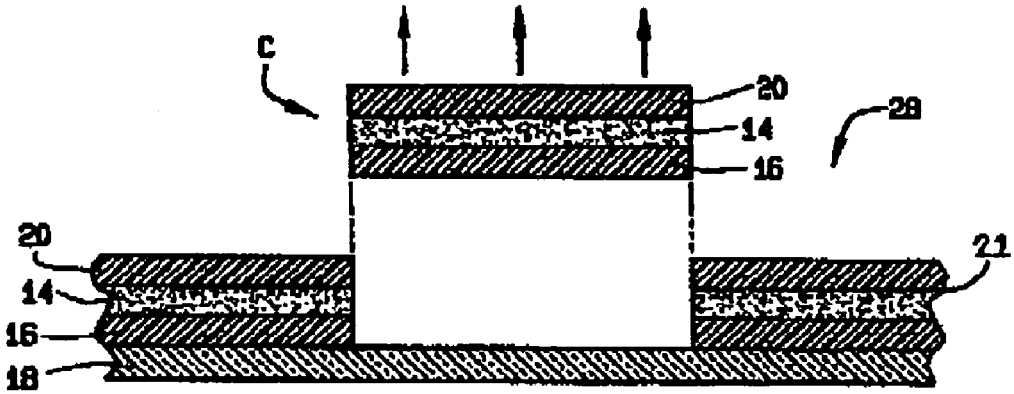
FIG. 3*a* is a cross-sectional view of the patch of FIGS. 1*a* and 2*a* showing the removal of the card from the patch and form structure.

Referring again to FIG. 3*a*, the integrated card C may be disengaged from the base layer 20 by pushing upward from the bottom of the patch 10 (against the primary film layer 18) so that the card C is disengaged with business form 28, permanent adhesive layer 14, and breakaway layer 16 integrated as a single unit, integrated card C. Referring again to FIG. 3*b*, first adhesive layer 14, secondary film layer 15, second adhesive layer 15.5, and breakaway layer 16 are integrated as a single unit, integrated card C. Integrated card C has a preferred thickness dimension of not more than 25 μm plus the thickness of the paper base layer 20 to which the patch 10 is attached. Thus, the extremely thin integrated card system that is described exhibits the characteristics of being extremely flexible, thin, but with significant resistance to tearing.

Figure 1B:
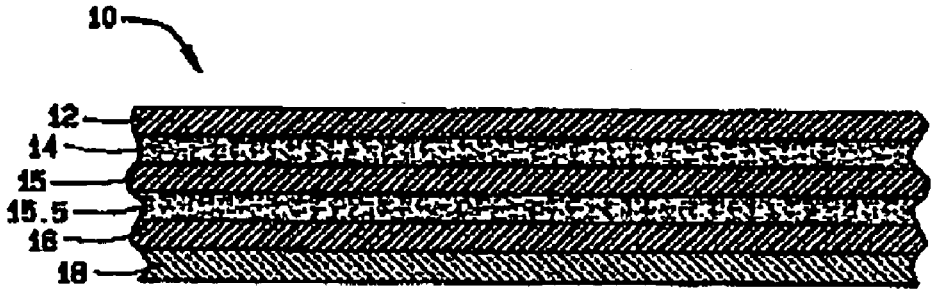
FIG. 1*b* is a cross-sectional view of the patch showing the additional optional secondary film and second adhesive layers of the patch.

It is presently preferred that the lamina with release agent layer 12 be made of a silicon so as to act as a liner separating the remaining layers from the underlying primary film layer 18 when rolled or stacked for storage. The permanent adhesive layers 14 and 15.5 may be manufactured from any adhesive product presently known or later discovered which will create a permanent adhesion between the layers below (see FIGS. 1 and 2) and the base paper layer 20 or secondary film layer 15 of FIGS. 2*a* and 2*b* respectively.

Figure 3B:
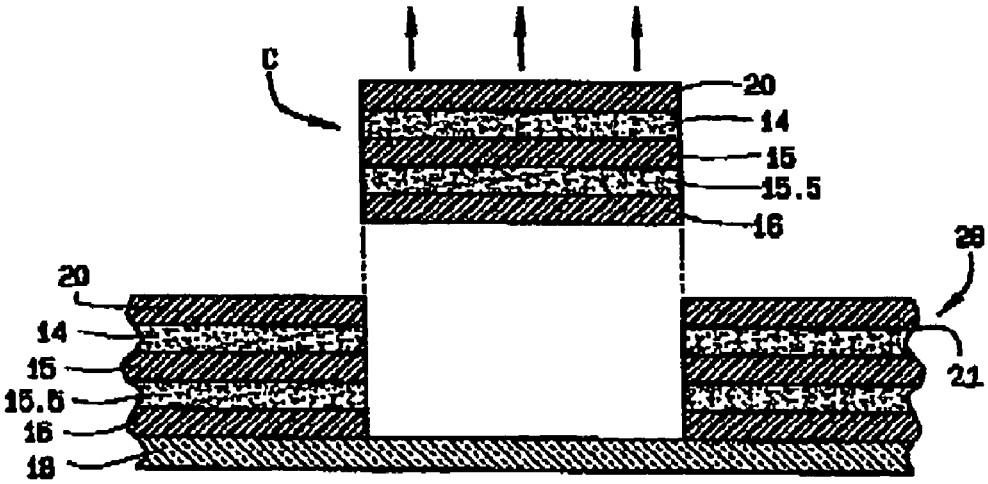
FIG. 3*b* is a cross-sectional view of the patch of FIGS. 1*b* and 2*b* showing the removal of the card including the additional optional secondary film and second adhesive layers from the patch and form structure.

The secondary film layer 15 of FIG. 2*b* and 3*b* may be a clear polyester, polypropylene, polystyrene, or any other film that makes the information card more rigid. The secondary film layer 15 should be thick enough to provide some rigidity to the information card once removed from the business form. The preferred thickness of secondary film layer 15 is 0.75 mils, but may range between 0.5 and 1.0 mil.

The breakaway layer 16 may be manufactured from urethane, acrylic, or acetate based polymers or any later discovered polymers having a greater affinity for the permanent adhesive layers 14 and 15.5 than primary film layer 18. The base paper layer 20 may consist of any applicable business form, preferably one that has been preprinted on its top and/or bottom surfaces. Although the base paper layer 20 can be any stock of suitable weight and thickness, in the preferred embodiment, the base paper layer 20 is paper stock of 20 lbs. to 100 lbs. weight and 0.002 of an inch to 8.0 mils thickness.

The integrated card C is readily disengaged from the business form 28 as it will pop out easily due to the significant difference in stiffness from the integrated card unit consisting of the top three layers 20, 14, and 16 in contrast to the bottom layer 18 composed of a clear crushed paper glassine material or other clear films including polyester or other papers. The integrated card C is even more easily removed when the five layers of FIGS. 2*b* and 3*b* are combined. Another significant feature of the integrated card C is that, in addition to the dry release characteristics of the breakaway layer 16, this layer (which is exposed when disengaged from the business form 28), provides a surface which is not only signature compatible, but which will also accept printed indicia of the end-user and textures transferred from the primary film layer including holograms.

Figure 4:
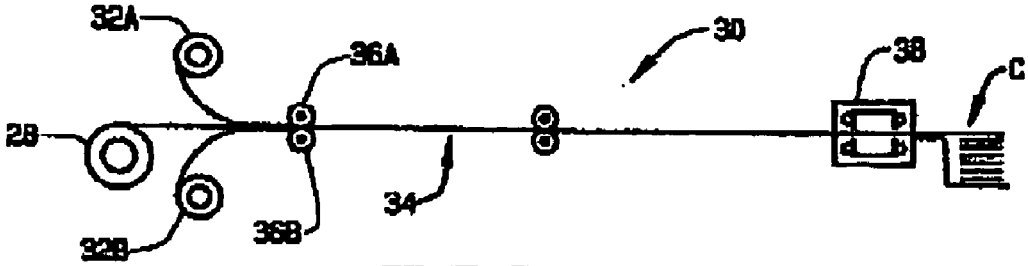
FIG. 4 is a diagrammatic view of the manufacturing process for attaching the patch to a business form.
Figure 5:
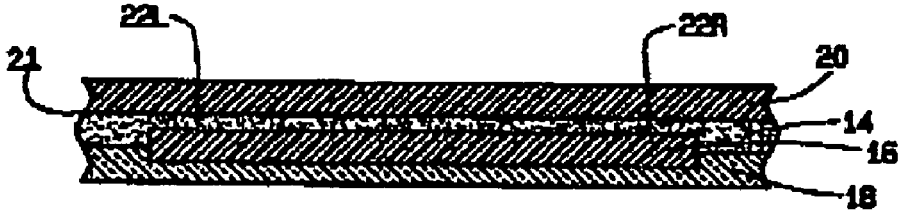
FIG. 5 is a cross-sectional view of a variant embodiment of the patch and form of FIG. 2*a*.
Figure 6:
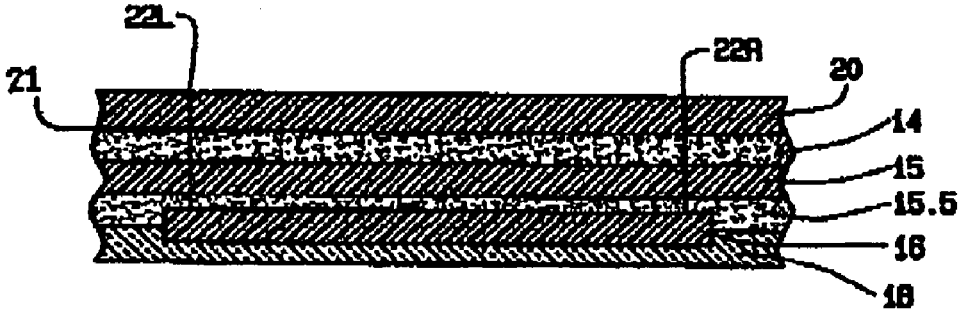
FIG. 6 is a cross-sectional view of a variant embodiment of the patch and form of FIG. 2*b*.
Figure 7:
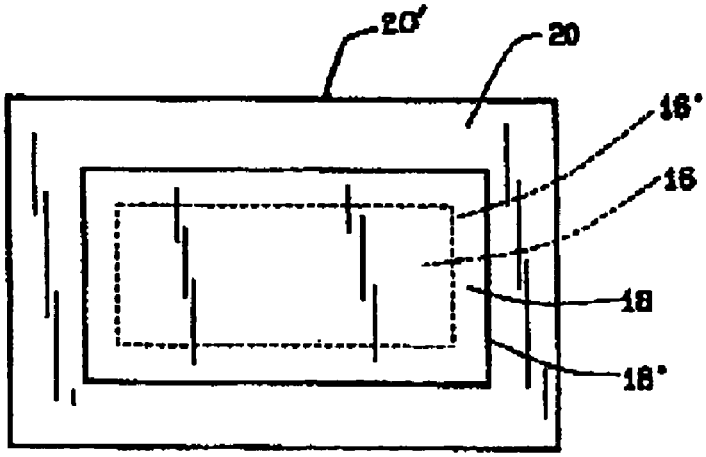
FIG. 7 is a plan view of the patch and form of FIGS. 2*a* and 2*b*.
Figure 8:
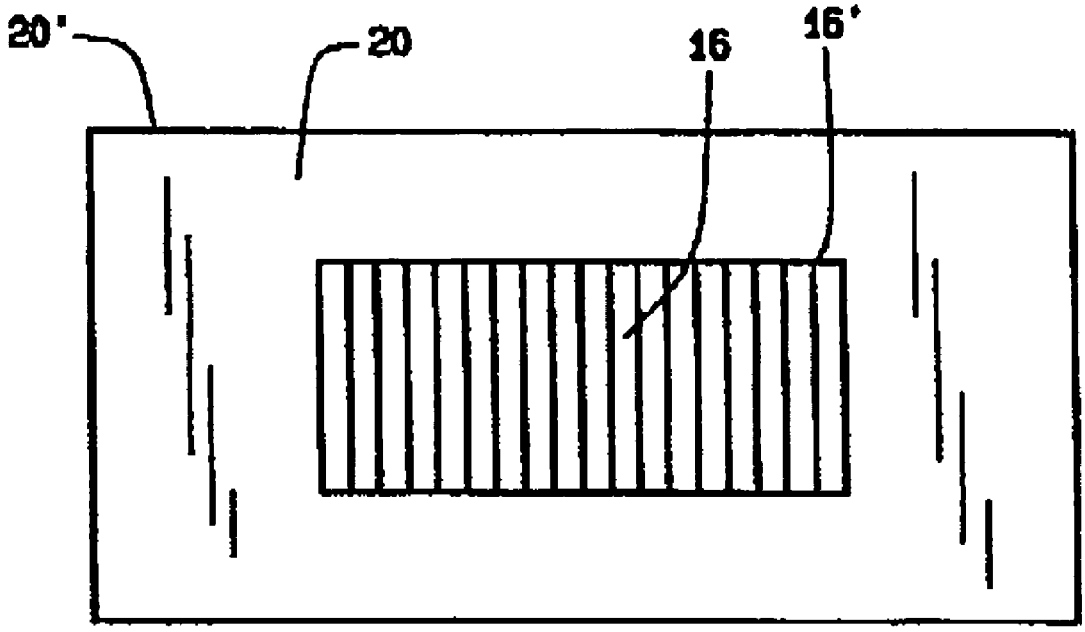
FIG. 8 is a plan view of the breakaway layer of FIGS. 2*a* and 2*b*.

Referring to FIG. 4, the present invention may be manufactured by feeding rolled business forms 28 into a manufacturing line 30. The forms 28 may be fed into the line 30 so that the underside (or reverse side) of the form 28 is either inverted or right side up to match the placement of the patch 10 on that side. The patch material 10 is fed into the line from a large roll 32A or 32B located above or below the business form web, respectively, so that the patch 10 will be positioned juxtaposed the bottom side of the business form. The patch material 10 is then directed along the web 34 so as to come into contact with a vacuum/cutting unit 36A or 36B (located, respectively, above or below the web and adjacent the patch material) which peels off the lamina with release agent 12, cuts the patch material 10 into appropriate dimensions, and presses (so as to adhere) the patch material 10 to the business forms 28 at pre-determined locations. One or more patches 10 may be adhered to the business form 28 in pre-determined locations as desired by the end-user. Next, the business forms 28 continue to travel along the web 34 until reaching a die cutting station 38 which die cuts from the respective side of the business form through the base paper layer 20, the permanent adhesive layer 14, and the breakaway layer 16 (this also die cuts the secondary film layer and second adhesive layer when incorporated). As the completed business forms with integrated cards C leave the line 30, they may be rolled, folded or cut and sheeted for storage. The diagrammatic representation of FIG. 4 shows a cut sheet business form (with integrated card C) stack to be bundled for later use.

When end-users receive a business form with one or more integrated cards C, they may easily remove each integrated card C by peeling it away from the form 28. The end-users may also manually sign, print or write on the bottom of the card as described above. The indicia which may be added to personalize the integrated card C, by adding printed and manually applied end-user information such as end-user name, address, signature, identification numbering, bar-code numbering, magnetic tape, company logo and holographic images.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

References to layers in this specification include sheets, webs, strips, and all other appropriate forms of laminas common in the industry. Similarly, as used herein, printing and printed indicia are meant to include all known methods of application of printed indicia to a substrate including photocopying, laser printing, impact, pre-printing, and handwriting.

What is claimed is:

1. A form with integrated card having a primary film layer, a secondary layer, and a breakaway layer disposed between at least parts of the primary film layer and the secondary layer, the improvement comprising:

a base paper layer having top and bottom surfaces and a periphery;

a primary film layer having top and bottom surfaces and a periphery;

a breakaway layer coated on the top of the primary film layer and within the periphery of the primary film layer;

an adhesive layer wherein the base paper layer bottom surface within the periphery of the base paper layer is adhesively secured to the breakaway layer;

at least one die cut through the top and bottom surfaces within the periphery of the base paper layer, through the adhesive layer, and through the breakaway layer;

the die cut base paper layer, adhesive layer, and breakaway layer comprises an information card;

wherein the breakaway layer comprises a single layer of dry release material that has a greater affinity for the adhesive layer than the top surface of the primary film layer such that when the information card is removed from the form, the breakaway layer stays adhered to the bottom surface of the adhesive layer, said breakaway layer having release levels with respect to the primary film layer that vary in a predetermined pattern at least within the periphery of the die cut; and, wherein the breakaway layer is formulated for its affinity to the primary film layer and is applied in a pattern such that an area furthest the periphery of the primary film layer receives a coating having greater affinity for the primary film layer and an area adjacent the periphery of the primary film layer receives a coating having less affinity for the primary film layer.

2. The form with integrated card of claim 1, wherein at least the bottom surface of the breakaway layer and the top and bottom surfaces of the base paper layer are capable of accepting printed indicia thereon.

3. The form with integrated card of claim 1, wherein the breakaway layer is composed of a substantially translucent material.

4. The form with integrated card of claim 1, wherein the breakaway layer is composed of a material that varies in thickness at different points along and across the primary film layer.

5. The form with integrated card of claim 1, wherein the die cut falls within an area of relatively lower release level of the breakaway layer.

6. The form with integrated card of claim 1, wherein the primary film layer is bonded directly to the base paper layer in predetermined areas.

7. A form with integrated card having a primary film layer, a secondary layer, and a breakaway layer disposed between at least parts of the primary film layer and the secondary layer, the improvement comprising:

a base paper layer having top and bottom surfaces and a periphery; surface of the primary film layer such that when the information card is removed from the form, a primary film layer having top and bottom surfaces and a periphery;

a breakaway layer coated on the top of the primary film layer and within the periphery of the primary film layer;

at least one die cut through the top and bottom surfaces within the periphery of the base the die cut base paper layer, adhesive layer, and breakaway layer comprises an information card;

wherein the breakaway layer comprises a single layer of dry release material that has a greater affinity for the adhesive layer than the top surface of the primary film layer such that when the information card is removed from the form, the breakaway layer stays adhered to the bottom surface of the adhesive layer, said breakaway layer having release levels with respect to the primary film layer that vary in a predetermined pattern at least within the periphery of the die cut; and, wherein the breakaway layer is formulated for its affinity to the primary film layer and is applied in a pattern such that an area adjacent the periphery of the primary film layer receives a polymer having greater affinity for the primary film layer and an area furthest the periphery of the primary film layer receives a polymer having less affinity for the primary film layer.

8. A form with integrated card having a primary film layer, a secondary layer, and a breakaway layer disposed between at least parts of the primary film layer and the secondary layer, the improvement comprising;

a base paper layer having top and bottom surfaces and a periphery a primary film layer having top and bottom surfaces and a periphery;

a breakaway layer coated on the top of the primary film layer and within the periphery of the primary film layer;

an adhesive layer wherein the base paper layer bottom surface within the periphery of the base paper layer is adhesively secured to the breakaway layer;

at least one die cut through the top and bottom surfaces within the periphery of the base paper layer, through the adhesive layer, and through the breakaway layer;

the die cut base paper layer, adhesive layer, and breakaway layer comprises an information card;

wherein the breakaway layer comprises a single layer of dry release material that has a greater affinity for the adhesive layer than the top surface of the primary film layer such that when the information card is removed from the form, the breakaway layer stays adhered to the bottom surface of the adhesive layer, said breakaway layer having release levels with respect to the primary film layer that vary in a predetermined pattern at least within the periphery of the die cut; and, wherein the primary film layer has predetermined areas of greeter and lesser affinity for the breakaway layer.

9. The form with integrated card of claim 8, wherein the area of greater affinity is adjacent the periphery of the primary film layer.

10. The form with integrated card of claim 8, wherein the area of greater affinity is spaced from the periphery of the primary film layer.

11. A form with integrated card comprising:

a primary film layer having top and bottom surfaces and a periphery;

a breakaway layer directly and removably bonded to the primary film layer;

a secondary film layer having top and bottom surfaces and a periphery adhesively bonded to the breakaway layer;

a base paper layer having top and bottom surfaces and a periphery adhesively bonded to the secondary film layer;

at least one die cut through the top and bottom surfaces within the periphery of the base paper layer, through the top and bottom surfaces within the periphery of the secondary film layer, and through the breakaway layer;

the die curt base paper layer, secondary film layer, and the breakaway layer comprise an information card;

wherein the breakaway layer comprises a single leyer of dry release material that is removably bonded to the primary film layer and permanently bonded to the secondary film layer such that when the information card is removed from the: form, the breakaway layer stays adhered to the bottom surface of the secondary film layer, said breakaway layer having release levels with respect to the primary film layer that vary in a predetermined pattern at least within the periphery of the die cut; and, wherein the breakaway layer is formulated for its affinity to the primary film layer and is applied in a pattern such that an area furthest the periphery of the primary film layer receives a coating having greater affinity for the primary film layer and an area adjacent the periphery of the primary film layer receives a coating having less affinity for the primary film layer.

12. The form with integrated card of claim 11, wherein at least the bottom surface of the breakaway layer and the top and bottom surfaces of the base paper layer are capable of accepting printed indicia thereon.

13. The form with integrated card of claim 11, wherein the breakaway layer is composed of a substantially translucent material.

14. The form with integrated card of claim 11, wherein the breakaway layer is composed of a material that varies in thickness at different points along and across the primary film layer.

15. The form with integrated card of claim 11, wherein the die cut falls within an area of relatively lower release level of the breakaway layer.

16. The form with integrated card of claim 11, wherein the primary film layer is bonded directly to the secondary film layer In predetermined areas.

17. A form with integrated card, comprising:

a primary film layer having top and bottom surfaces and a periphery;

a breakaway layer directly and removably bonded to the primary film layer;

a secondary film layer having top and bottom surfaces and a periphery adhesively bonded to the breakaway layer;

a base paper layer having top and bottom surfaces and a periphery adhesively bonded to the secondary film layer;

at least one die cut through the top and bottom surfaces within the periphery of the base paper layer, through the top and bottom surfaces within the periphery of the secondary film layer, and through the breakaway layer;

the die cut base paper layer, secondary film layer, and the breakaway layer comprise an information card;

wherein the breakaway layer comprises a single layer of dry release material that is removable bonded to the primary film layer and permanently bonded to the secondary film layer such that when the information card is removed from the form, the breakaway layer stays adhered to the bottom surface of the secondary film layer said breakaway layer having release levels with respect to the primary film layer that vary in a predetermined pattern at least within the periphery of the die cut; and, wherein the breakaway layer Is formulated for its affinity to the primary film layer and is applied in a pattern such that an area adjacent the periphery of the primary film layer receives a polymer having greater affinity for the primary film layer and an area furthest the periphery of the primary film layer receives a polymer having less affinity for the primary film layer.

18. A form with Integrated card comprising:

a primary film layer having top and bottom surfaces and a periphery;

a breakaway layer directly and removable bonded to the primary film layer;

a secondary film layer having top and bottom surfaces and a periphery adhesively bonded to the breakaway layer, a base paper layer having top and bottom surfaces and a periphery adhesively bonded to the secondary film layer;

at least one die cut through the top and bottom surfaces within the periphery of the base paper layer, through the top and bottom surfaces within the periphery of the secondary film layer, and through the breakaway layer;

the die cut base paper layer, secondary film layer, and the breakaway layer comprise an information card;

wherein the breakaway layer comprises a single layer of dry release material that is removably bonded to the primary film layer and permanent bonded to the secondary film layer such that when the information card is removed from the form, the breakaway layer stays adhered to the bottom surface of the secondary film layer, said breakaway layer having release levels with respect to the primary film layer that vary in a predetermined pattern at least within the periphery of the die cut; and, wherein the primary film layer has predetermined areas of greater and lesser affinity for the breakaway layer.

19. The form with integrated card of claim 18, wherein the area of greater affinity is adjacent the Periphery of the primary film layer.

20. The form with integrated card of claim 18, wherein the area of greater affinity spaced from the periphery of the primary film layer.

21. The form with integrated card of claim 18, wherein the die cut falls within an area of relatively lower release level of the breakaway layer.

22. The form with integrated card of claim 18, wherein the primary film layer is bonded directly to the secondary film layer in predetermined areas.

23. The form with integrated card of claim 18, wherein at least the bottom surface of the breakaway layer and the top and bottom surfaces of the base paper layer are capable of accepting printed indicia thereon.

24. The form with integrated card of claim 18, wherein the breakaway layer is composed of a substantially translucent material.

25. The form with integrated card of claim 18, wherein the breakaway layer is composed of a material that varies in thickness at different points along and across the primary film layer.

* * * * *